US005489915A

United States Patent [19]

Bortniker

[11] Patent Number: 5,489,915

[45] Date of Patent: Feb. 6, 1996

[54] PORTABLE COLLAPSIBLE ANTENNA

[76] Inventor: Matthew J. Bortniker, 202 Fathom Cove, Stafford, Va. 22554

[21] Appl. No.: 320,901

[22] Filed: Oct. 11, 1994

[51] Int. Cl.[6] ..... H01Q 7/02

[52] U.S. Cl. ..... 343/871; 343/818; 343/880; 343/890

[58] Field of Search ..... 343/818, 823, 343/880, 881, 871, 878, 875, 890, 892, 915; 211/1.3, 119.01, 171

[56] References Cited

U.S. PATENT DOCUMENTS

| | | | |
|---|---|---|---|
| 2,259,390 | 10/1941 | Monckmeier | 211/171 |
| 2,616,571 | 11/1952 | Griffin | 211/171 |
| 3,329,960 | 7/1967 | Winegard | 343/915 |
| 3,427,769 | 2/1969 | Star | 52/113 |
| 3,541,566 | 11/1970 | Riebsamen | 343/882 |
| 3,587,103 | 6/1971 | Lawrie | 343/709 |
| 3,715,760 | 2/1973 | Palmer | 343/915 |
| 4,249,185 | 2/1981 | De Cesari | 343/881 X |
| 4,460,895 | 7/1984 | Bert | 343/713 |
| 4,471,360 | 9/1984 | Cotterman | 343/805 |
| 4,626,866 | 12/1986 | Lindberg | 343/880 |
| 4,825,225 | 4/1989 | Waters | 343/881 |

FOREIGN PATENT DOCUMENTS

| | | |
|---|---|---|
| 1080634 | 4/1960 | Germany . |

*Primary Examiner*—Donald T. Hajec
*Assistant Examiner*—Tho Phan
*Attorney, Agent, or Firm*—Watson, Cole, Grindle & Watson

[57] ABSTRACT

A tubular mast has a tubular boom detachably mounted thereon, and a plurality of tubular antenna elements are detachably mounted on the boom. An elastic cord is disposed within and is connected to the boom. A further elastic cord is disposed within and is connected to the mast. Additional elastic cords are disposed within and are connected to the antenna elements. The elastic cords disposed within the mast and the antenna elements are slidably connected to the cord portion disposed within the boom. The elastic cords maintain the components in operative position and allow the components to be detached from one another to fold the antenna into collapsed position.

20 Claims, 3 Drawing Sheets

72
70
74
62"
14
92
130
88
62'
88
92
14'
86
14'
86
130
74
70
72
130
120
102
130
130
130
130
100
106

110
108
130
102
130
102
102
130
102
130
130
102
104
120
102
122
122

110

PORTABLE COLLAPSIBLE ANTENNA

BACKGROUND OF THE INVENTION

The present invention relates to a portable collapsible antenna suitable for receiving radio frequency signals. Such antennas are designed to be transported into the field where they can be assembled and disassembled when desired. Various means have been provided for assembling and disassembling these types of antennas including the use of brackets and screws as well as nut and bolt arrangements for securing the components of the antenna in operative position.

These prior art antennas are not satisfactory since they are heavy and bulky in construction. They are accordingly difficult to carry into position. Assembling and disassembling such antennas is excessively time consuming and usually requires the use of certain tools. These constructions are susceptible to failure, and if damaged, they are difficult to repair in the field. Furthermore, even when collapsed, many prior art antennas are difficult to manipulate and carry into position.

SUMMARY OF THE INVENTION

The present invention incorporates a construction wherein a tubular relatively rigid boom is detachably mounted on a tubular relatively rigid mast. A plurality of tubular relatively rigid antenna elements are detachably mounted on the boom. Elastic cord means is disposed within and is connected to the antenna components so that the cord means maintains the antenna components in mounted position relative to one another and permits the antenna components to be detached from one another and folded into a collapsed position. In the collapsed position, the components may be folded and disposed in adjacent generally parallel relationship with one another so as to provide a compact collapsed arrangement which can be easily manipulated and carried into position.

The elastic cord means includes a first elongated cord portion and a plurality of separate additional cord portions. Each of the separate cord portions is connected to the first cord portion so that the separate cord portions are adapted to provide tension on the antenna components such that the boom is retained in position on the mast and the antenna elements are retained in position on the boom. The separate cord portions are slidably connected to the first cord portion so that they can slide off of the ends of the first cord portion.

In the event that it is necessary to replace or repair one of the cord portions, the cord portions can be disassembled from one another by sliding the separate cord portions off of the first cord portion. Accordingly, any particular cord portion may be individually replaced or repaired, thereby enabling the cord means to be modified in a simple and effective manner, and wherein such modifications may be made in the field when necessary.

The antenna components are of tubular construction and are formed of a lightweight material such as aluminum. Accordingly, the antenna is easy to transport from place to place. The antenna can be carried in a tubular case, if desired, and can be erected in a minimum amount of time without the use of any tools or spare parts. The components can be manually manipulated in a simple manner from the collapsed folded position into the operative mounted position wherein the components extend at generally right angles to one another and are maintained in operative position by the tension of the elastic cord means.

When it is desired to collapse the antenna, the components can be detached from one another against the tension of the elastic cord means and then folded into collapsed position. The construction incorporates a minimum of parts and is less susceptible to failure than prior art antennas. The antenna is also easy to repair in the field if it should become damaged.

DESCRIPTION OF THE PREFERRED EMBODIMENT

Figures 1, 4, 8:
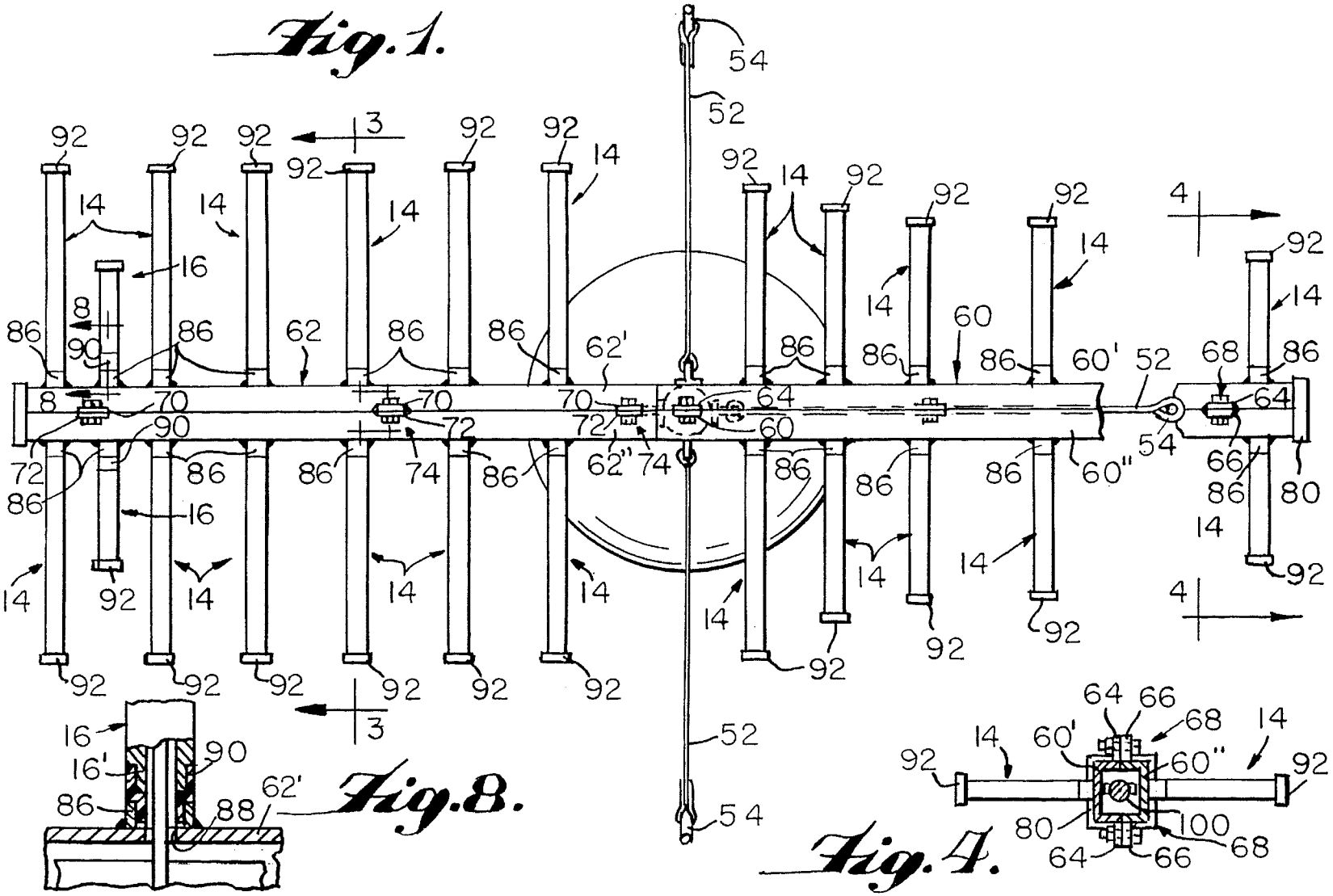
FIG. 1 is a top view, partly broken away, of an antenna according to the invention.
FIG. 4 is a sectional view taken along line 4—4 of FIG. 1.
FIG. 8 is a sectional view taken along line 8—8 of FIG. 1.
Figures 2, 5, 7:
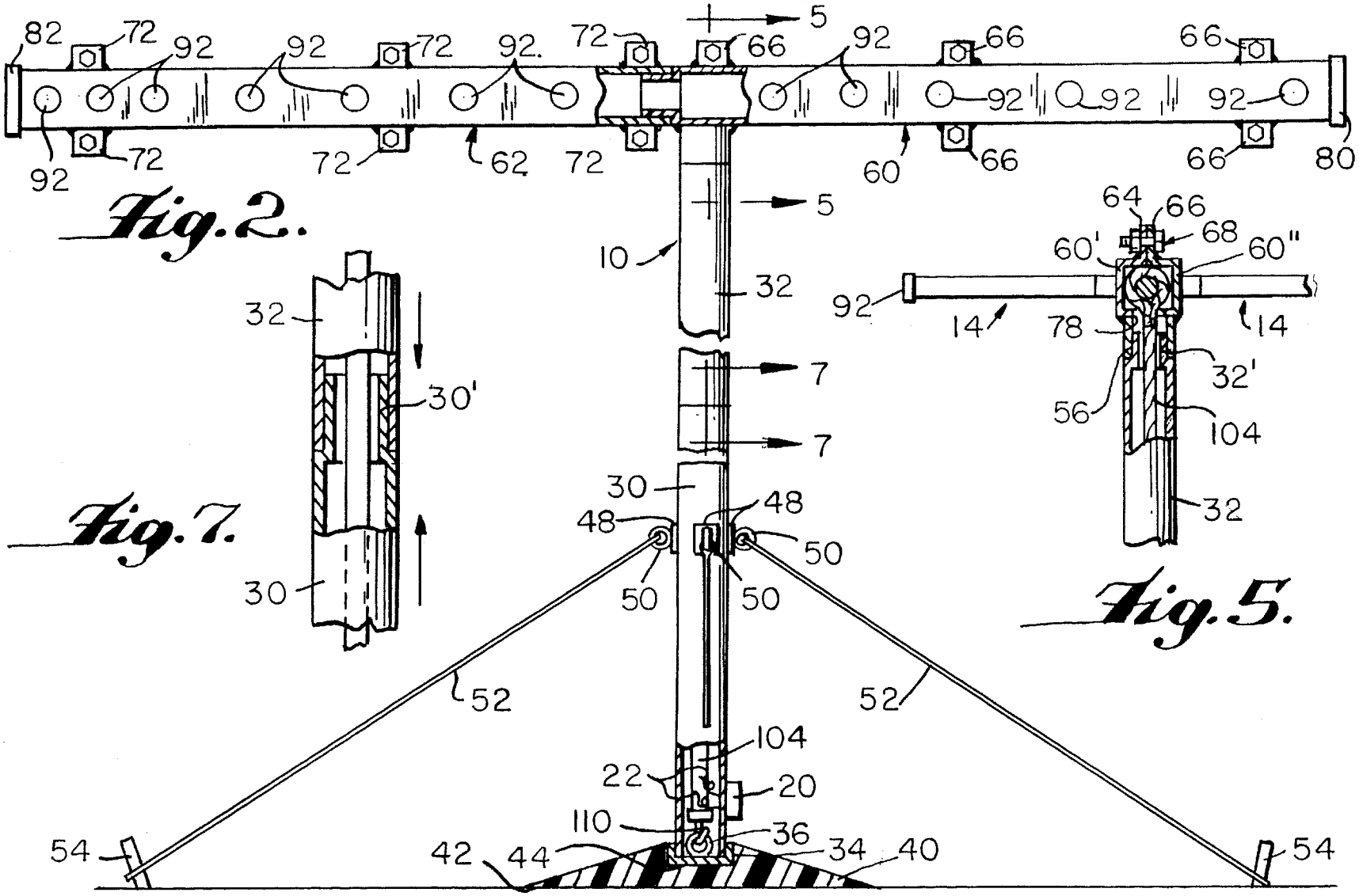
FIG. 2 is an elevation, partly broken away, of the antenna shown in FIG. 1.
FIG. 5 is a sectional view taken along line 5—5 of FIG. 2.
FIG. 7 is a sectional view taken along line 7—7 of FIG. 2.

Referring now to the drawings wherein like reference characters designate corresponding parts throughout the several views, there is shown in FIGS. 1 and 2 a conventional yagi-type antenna which according to the invention has tubular relatively rigid antenna components including a mast 10, a boom 12 detachably supported at the upper end of the mast, and a plurality of antenna elements 14 which are detachably supported on the boom. A pair of driven elements 16 are also provided, these elements comprising a conventional reflector. It will be noted that the elements are of different lengths and are spaced at varying distances from one another according to the operating frequencies of the received radio waves.

The antenna components are all of tubular construction and are formed of a suitable lightweight material such as aluminum. The mast may be of circular cross-section, and as seen in FIG. 2, a conventional coaxial cable connector 20 (or other conventional connector) is supported on the outer surface of the mast, the coaxial connector including a pair of leads 22 which are connected in the usual manner to the driven elements of the antenna.

The mast comprises a pair of sections 30 and 32 which as seen in FIG. 7 are telescopically engaged with one another, the lower section 30 having a reduced upper end portion 30' which fits snugly within the open lower end of section 32. As seen in FIG. 2, the open lower end of section 30 of the mast has a cap 34 disposed thereover, the cap having a cap connector 36 in the form of an eye-ring secured to the inner surface thereof for a purpose hereinafter described.

A base 40 of flattened pyramidal cross-section is formed of plastic or other suitable strong substance, the base having a flat bottom surface 42 for resting on a supporting surface such as the ground. The base has an upwardly facing generally cylindrical recess 44 formed therein which is adapted to receive the cap 34 of the mast to thereby support the lower end of the mast. The mast has a plurality of equally spaced plates 48 attached thereto, the plates each including an eye-ring 50 fixed thereto and extending perpendicular thereto. A plurality of guy wires 52 are connected between the eye rings 50 and stakes 54 which are driven into the ground.

As seen in FIG. 5, the upper end of mast section 32 is provided with a reduced upper end portion 32' which fits snugly within the lower open end of a cylindrical member 56, the upper open end of which is secured as by welding to the lower surface of the boom. As seen in FIGS. 1 and 3–5, the boom is formed in two sections 60 and 62 which are formed in two parts 60', 60" and 62' and 62" respectively. Each of members 60', 60", 62' and 62" is of generally C-shaped cross-section and they cooperate to define a boom having a hollow interior.

Integral ears 64 and 66 are formed on the upper and lower edges of members 60' and 60" respectively, these ears being disposed adjacent one another and being provided with suitable aligned holes formed therethrough for receiving nut and bolt assemblies 68 which rigidly connect members 60' and 60" together. Integral ears 70 and 72 are formed on the upper and lower edges of members 62' and 62" respectively, these ears being disposed adjacent one another and being provided with suitable aligned holes formed therethrough for receiving nut and bolt assemblies 74 which rigidly connect members 62' and 62" together.

Referring to FIG. 5, the bottom flanges of members 60' and 60" are provided with semi-circular cutouts to form a circular opening 78 for receiving a mast portion of the elastic cord means. As seen in FIG. 2, the boom sections 60 and 62 are telescopically engaged with one another, section 62 having a reduced end portion 63 which is snugly received within the open end of section 62. The opposite open ends of the boom are covered by caps 80 and 82 similar in construction to cap 34 previously described and which include similar cap connectors secured to the inner surfaces thereof for a purpose hereinafter described.

Figures 3, 6, 6A:
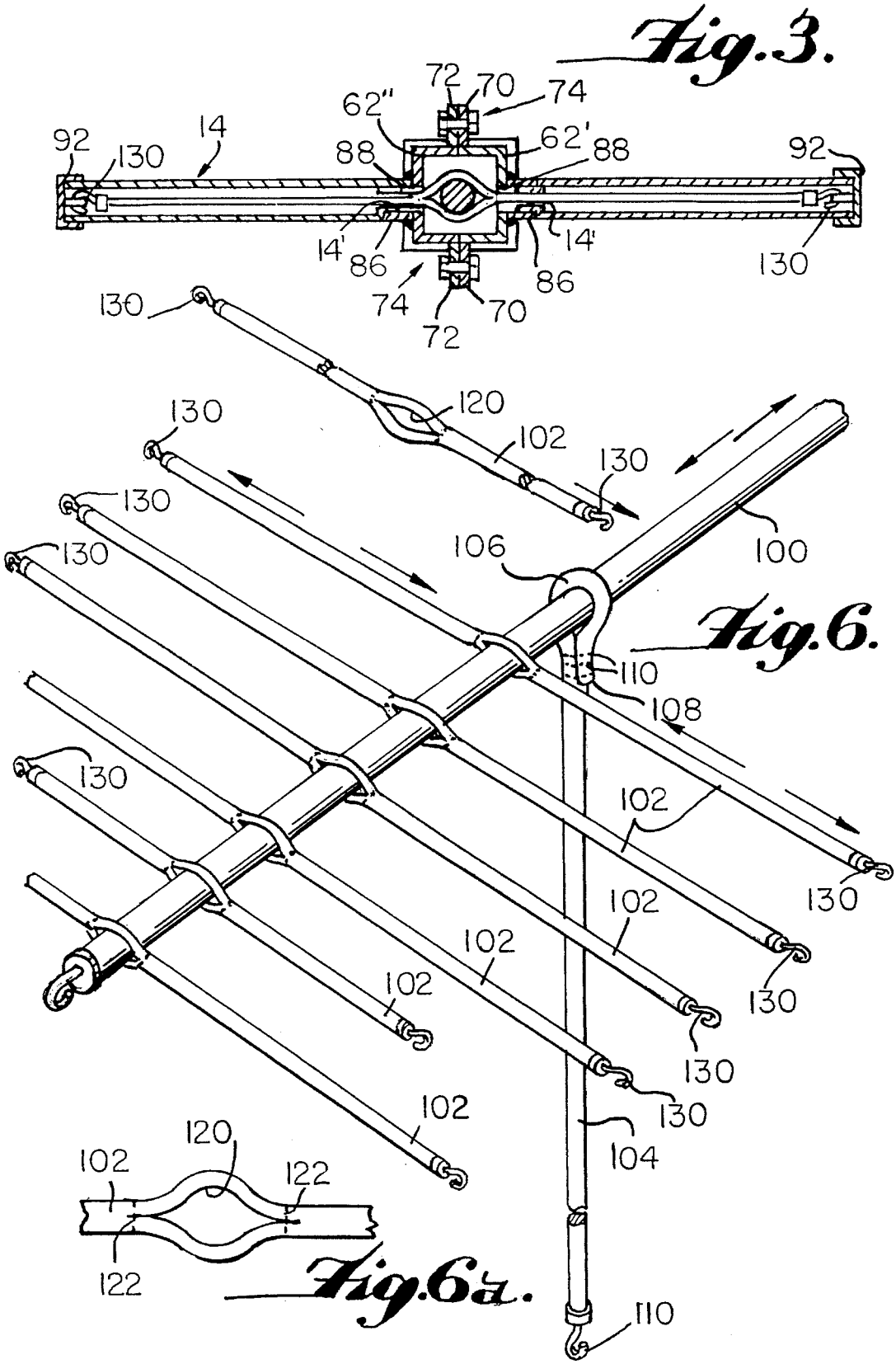
FIG. 3 is a sectional view taken along line 3—3 of FIG. 1.
FIG. 6 is a top perspective view of a portion of the elastic cord means.
FIG. 6*a* is a view of part of an element portion of the cord means.

The construction of all of the antenna elements 14 is similar, and a typical example is shown in FIG. 3 wherein each element is of generally circular cross-section and includes a reduced end portion 14' which is received within a substantially cylindrical mounting portion 86 welded to the outer surface of one of the associated boom parts. Each mounting portion 86 has a bore formed therethrough which is aligned with a hole 88 formed through the associated boom part.

Therefore, a plurality of holes are formed through each of the boom parts at longitudinally spaced points therealong, with a mounting portion secured to the boom part at each hole so that the bore in each mounting portion is in communication with the associated hole in the boom part. As seen in FIG. 8, each driven element 16 is provided with a reduced inner end portion 16' which is snugly received within the open outer end of a member 90 formed of electrical insulating material and having the configuration shown. The inner end of each insulating member is in turn snugly received within one of the mounting portions 86. Referring again to FIG. 3, each of the elements 14 and 16 is provided with an element cap 92 similar in construction to cap 34 previously described and having a similar cap connector secured to the inner surface thereof for a purpose hereinafter described.

Referring now to FIG. 6, the elastic cord means of the invention is illustrated. The cord means is elastic throughout and comprises bungee or shock cord which is known to have relatively uniform elasticity and which retains its elasticity for a long period of time. The cord means includes a first elongated cord or boom portion 100 which is adapted to be disposed within the boom and connected thereto. A plurality of separate additional cord or element portions 102 are adapted to be disposed within the antenna elements and connected thereto. A further separate additional cord or mast portion 104 is adapted to be disposed within the mast and connected thereto.

The opposite ends of cord portion 100 have cord connectors 101 in the form of hooks 101 secured thereto. These hooks are adapted to engage the eye-ring cap connectors on boom caps 80. When the connectors at opposite ends of boom cord portion 100 are engaged with the connectors on the boom caps, portion 100 is placed under sufficient tension so that the separate cord portions slidably engaged therewith will be retained under adequate tension with the components associated therewith.

The upper end of cord portion 104 includes a loop 106 which extends around cord portion 100, the terminal end 108 of cord portion 104 being stitched to the cord portion to slidably connect the upper end of cord portion 104 to cord portion 100. The lower end of cord portion 104 has a cord connector 110 secured thereto, this cord connector being in the form of a hook which is adapted to engage cap connector 36 on cap 34. When these connectors are engaged with one another, the length of cord connector 104 and the mast are such that a suitable amount of tension is transmitted from the cord portion to the boom to retain the mast and boom in assembled operative position. This tension may be overcome when it is desired to detach the mast from the boom, whereupon the mast and boom may be folded with respect to one another to be disposed in generally parallel relationship with one another.

Each of the separate cord portions 102 is slit longitudinally as seen most clearly in FIG. **6*a* to provide a slit 120 at a medial part of each of the cord portions. Stitching 122 is provided at opposite ends of the slit to prevent the slit from splitting the cord portion further along its length. The opening provided by the slit is of such a dimension so as to slidably receive the cord portion 100 so that cord portions 102 may slide along cord portion 100, while the cord portions 102 are restrained from moving laterally of cord portion 100, or in other words, in a direction extending longitudinally of the cord portions 102**.

Each of separate cord portions 102 has cord connectors 130 connected to the opposite ends thereof, these connectors also being in the form of hooks for engaging the eye-ring connectors on the asssociated element caps 92. When the connectors on the cord portions and the element caps are interengaged with one another, sufficient tension is provided to ensure that the antenna elements are retained in engagement with the associated mounting portions. When it is desired to collapse the antenna, the antenna elements can be pulled outwardly away from the boom to detach the antenna elements from the mounting portions whereupon the antenna elements can be folded into generally parallel with relationship with the boom.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A portable collapsible antenna comprising a plurality of elongated tubular relatively rigid antenna components detachably connected to one another, and elastic cord means disposed within and connected to said antenna components so that said cord means maintains said components in mounted position relative to one another and permits said components to be detached from one another to fold the antenna into collapsed position, said cord means including a first elongated cord portion and a plurality of separate additional cord portions connected to and extending laterally of said first cord portion.

2. An antenna as defined in claim 1 wherein said separate cord portions are slidably connected to said first cord portion.

3. An antenna as defined in claim 1 wherein said first cord portion has cord connectors secured to opposite ends thereof, and each of said separate cord portions having a cord connector secured to at least one end thereof.

4. An antenna as defined in claim 3 wherein some of said separate cord portions have cord connectors secured to opposite ends thereof.

5. An antenna as defined in claim 1 wherein one of said separate cord portions has an end portion which is looped around said first cord portion for sliding movement along said first cord portion.

6. An antenna as defined in claim 1 wherein a plurality of said separate cord portions are each connected at an intermediate point along the length thereof to said first cord portion and having opposite ends extending away from said first cord portion in opposite directions.

7. An antenna as defined in claim 1 wherein a plurality of said separate cord portions are slit longitudinally at medial parts thereof to form slits therethrough, said first cord portion extending through the slits in said separate cord portions.

8. A portable collapsible antenna comprising an elongated tubular relatively rigid mast, an elongated tubular relatively rigid boom detachably mounted on said mast, a plurality of elongated tubular relatively rigid antenna elements detachably mounted on said boom, and elongated elastic cord means including a boom portion disposed within and connected to said boom, said cord means including element portions disposed within and connected to said elements so that said cord means maintains said boom and elements in mounted position relative to one another and permits said boom and elements to be detached from one another to fold the antenna into collapsed position.

9. An antenna as defined in claim 8 wherein said boom has opposite open ends, a cap disposed over each of said open ends, each cap having cap connectors secured thereto, said boom portion of said cord means having cord connectors at opposite ends thereof for engaging said cap connectors.

10. An antenna as defined in claim 8 wherein said boom has a plurality of longitudinally spaced holes formed therethrough, a plurality of mounting portions secured to said boom and extending away therefrom, said mounting portions each having a bore formed therethrough, each of said bores being in communication with one of said holes.

11. An antenna as defined in claim 10 wherein each of said elements has an inner portion for detachably engaging one of said mounting portions.

12. An antenna as defined in claim 8 wherein each of said elements has an open outer end, a cap disposed over each of said open outer ends, each cap having cap connectors secured thereto, said element portions of said elastic cord means having cord connectors at opposite ends thereof for engaging said cap connectors.

13. An antenna as defined in claim 8 wherein two of said elements comprise driven elements, and insulating means disposed between said driven elements and said boom to electrically insulate said driven elements from the boom.

14. A portable collapsible antenna comprising an elongated tubular relatively rigid mast, an elongated tubular relatively rigid boom detachably mounted on said mast, a plurality of elongated tubular relatively rigid antenna elements detachably mounted on said boom, and elongated elastic cord means including a boom portion disposed within and connected to said boom, a mast portion disposed within and connected to said mast and element portions disposed within and connected to said elements so that said cord means maintains said boom, mast and elements in mounted position relative to one another and permits said boom, mast and elements to be detached from one another to fold the antenna into collapsed position.

15. An antenna as defined in claim 14 including a base having an upwardly facing recess therein, said mast having a lower end removably supported within said recess.

16. An antenna as defined in claim 15 wherein said mast has an open lower end, and a cap disposed over said open lower end, said cap being disposed within said recess.

17. An antenna as defined in claim 14 wherein said mast has an open lower end, a cap disposed over said open lower end, said cap having a cap connector secured thereto, said mast portion of the cord means having a cord connector at the lower end thereof for engaging said cap connector.

18. An antenna as defined in claim 14 wherein a first plurality of elements is disposed along a first part of the boom, a second plurality of elements being disposed along a second part of the boom opposite to said first part of the boom and being aligned with said first plurality of elements, each of said element portions of the cord means being disposed within aligned pairs of elements on said opposite parts of the boom.

19. An antenna as defined in claim 14 wherein said boom is formed in two sections which are telescopically engageable with one another.

20. An antenna as defined in claim 19 wherein each of said boom sections is formed in two parts, and securing means for securing the two parts of the boom sections to one another.

* * * * *